US006728980B1

(12) United States Patent
Chen

(10) Patent No.: US 6,728,980 B1
(45) Date of Patent: May 4, 2004

(54) BASSINET

(75) Inventor: Shun Min Chen, Taipei Hsien (TW)

(73) Assignee: Kenny Cheng, Taipei (TW)

( * ) Notice: Subject to any disclaimer, the term of this patent is extended or adjusted under 35 U.S.C. 154(b) by 0 days.

(21) Appl. No.: 10/437,099

(22) Filed: May 13, 2003

(51) Int. Cl.[7] ..... A47D 9/04
(52) U.S. Cl. ..... 5/93.1; 5/105; 5/106
(58) Field of Search ..... 5/93.1, 97, 98.3, 5/101, 105, 106, 620, 310; 16/34, 19, 32, 35

(56) References Cited

U.S. PATENT DOCUMENTS 287,721 A * 10/1883 Ranney ..... 5/106
744,993 A * 11/1903 Barta ..... 5/105
2,106,927 A * 2/1938 Kinnear ..... 5/106
2,401,605 A * 6/1946 John ..... 5/97
2,604,333 A * 7/1952 Elmer ..... 280/37
5,480,170 A * 1/1996 Kaiser, II ..... 280/30

* cited by examiner

*Primary Examiner*—Teri Pham Luu
*Assistant Examiner*—Fredrick Conley
(74) *Attorney, Agent, or Firm*—Gauthier & Connors, LLP

(57) ABSTRACT

The present application provides a bassinet comprising a cart including a lower portion which has two substantially U-shaped members, and an upper portion movably coupled to the lower portion, a bed portion detachably coupled to the upper portion of the cart; height adjusting means installed to the cart for adjusting the height of the cart, and four leg assemblies coupled to a lower portion of the cart and each of the leg assembly has a wheel unit which can be operated to locked at a erected position and a retracted position where the wheel unit is received in the leg assembly. The bassinet may perform a function similar to a cradle when the wheel units are retracted into the leg assemblies and the bed portion may be detached from the cart to use separately.

9 Claims, 11 Drawing Sheets

BASSINET

FIELD OF THE INVENTION

The present invention relates generally to a height adjustable bassinet and more particularly, to a bassinet that can be used as a cradle and has a bed portion, which can be detached from the bassinet to be used separately.

BACKGROUND OF THE INVENTION

A bassinet is one of nursery goods. As shown in FIG. 10, a traditional bassinet 100 includes a cart 101 and a bed portion 102 fixedly attached to the cart 101. The cart 101 includes an upper frame consisting of two substantially reversed U-shaped members 103 each having two arms, and a lower frame consisting of four tubes 104 respectively fixed to one arm of the U-shaped members 103, two arcuate tubes 105, and four wheel assemblies 106 coupling the arcuate tubes 105 to tubes 104. In addition, two connecting rods 107 are provided along the long sides of the cart to connect two wheel assemblies 106 and a plurality of openings (not shown) are provided along each arm of the U-shaped members to allow height adjustment of the cart. A wheel 108 is provided to each of the wheel assemblies 107 and the wheel 108 can be retracted within the wheel assembly 107 to allow the arcuate tubes 105 to contact the ground so as to allow the bassinet to work as a rocking cradle.

Although the traditional bassinet can perform certain functions, the bed portion 102 of the traditional bassinet is fixedly screwed to the cart and unable to be detached form the cart to use separately. In addition, the height adjustment of the traditional bassinet is awkward because a user has to operate four locking members (not shown) on the tubes 104 to perform this height adjustment and this make the height adjusting very inconvenient.

SUMMARY OF THE INVENTION

Accordingly, one object of the present invention is to provide a bassinet, which can be easily assembled and operated and a bed portion of the bassinet can be detached from the bassinet so as to use separately.

Another object of the present invention is to provide a bassinet whose height can be easily and conveniently adjusted.

To achieve these and other objects, the bassinet according to the present application comprises a cart including a lower portion which has two substantially U-shaped members, and an upper portion movably coupled to the lower portion, wherein each of the U-shaped members has two arm tubes and an arcuate connection portion connecting two arm tubes and each arm tube has a plurality of height adjusting holes formed in a tube wall along an axial direction, and the upper portion comprises four vertical tubes and four connecting rods, one end of each vertical tubes being telescopely coupled to an arm tube of the U-shaped members and the other end is coupled to and adjacent vertical tube by a connecting rod, wherein each vertical tube has a slot formed in a tube wall thereof to align with the height adjusting holes; height adjusting means operablely coupled to the cart and adapted to allow a height of the cart may be adjusted by selectively interlocking the upper portion and the lower portion of the cart may; a bed portion detachably coupled to the upper portion of the cart; and four leg assemblies each coupled to a joint of the arm tube and the connection portion of the U-shaped members, wherein each leg assembly has a housing fixedly attached to the U-shaped members and a wheel unit retractably coupled to the housing.

According to one embodiment of the present application, the height adjusting means comprises at least one actuating device operably installed to the upper portion of the cart; at least one locking device installed inside the vertical tubes and having a lock member; at least one cable operably connecting the at least one locking device to the at least one actuating device such that the at least one locking device may selectively engage/disengage with the slot of the arm tube of the U-shaped members and one of the height adjusting holes in the vertical tubes under the operation of the at least one actuating device.

The bed portion comprises a bed, a frame fixed to the bed, attaching means provided to a bottom face of the bed and adapted to detachably couple the bed to at least two oppose connecting rods of the upper portion of the cart, a number of support members provided at the bottom face of the bed and arranged such that the support members will abut an inner side of the connecting rods while the bed portion is coupled to the cart. The attaching means comprises two substantially C-shaped coupling member disposed at two opposite sides of the bottom face of the bed. In addition, a height of each of the support members is the same and equals to a height of the attaching member.

The wheel unit comprises

It is to be appreciated that both the forging general description and the following detailed description are exemplary and explanatory and are intended to provide further explanations of the invention as claimed.

BRIEF DESCRIPTION OF THE DRAWINGS

The accompanying drawings, which are included to provide a further understanding of the invention and are incorporated in and constitute a part of the specification, illustrate embodiments of the invention and together with the description serve to explain the principle of the invention. In the drawings.

DETAILED DESCRIPTION OF THE INVENTION

Figure 1A:
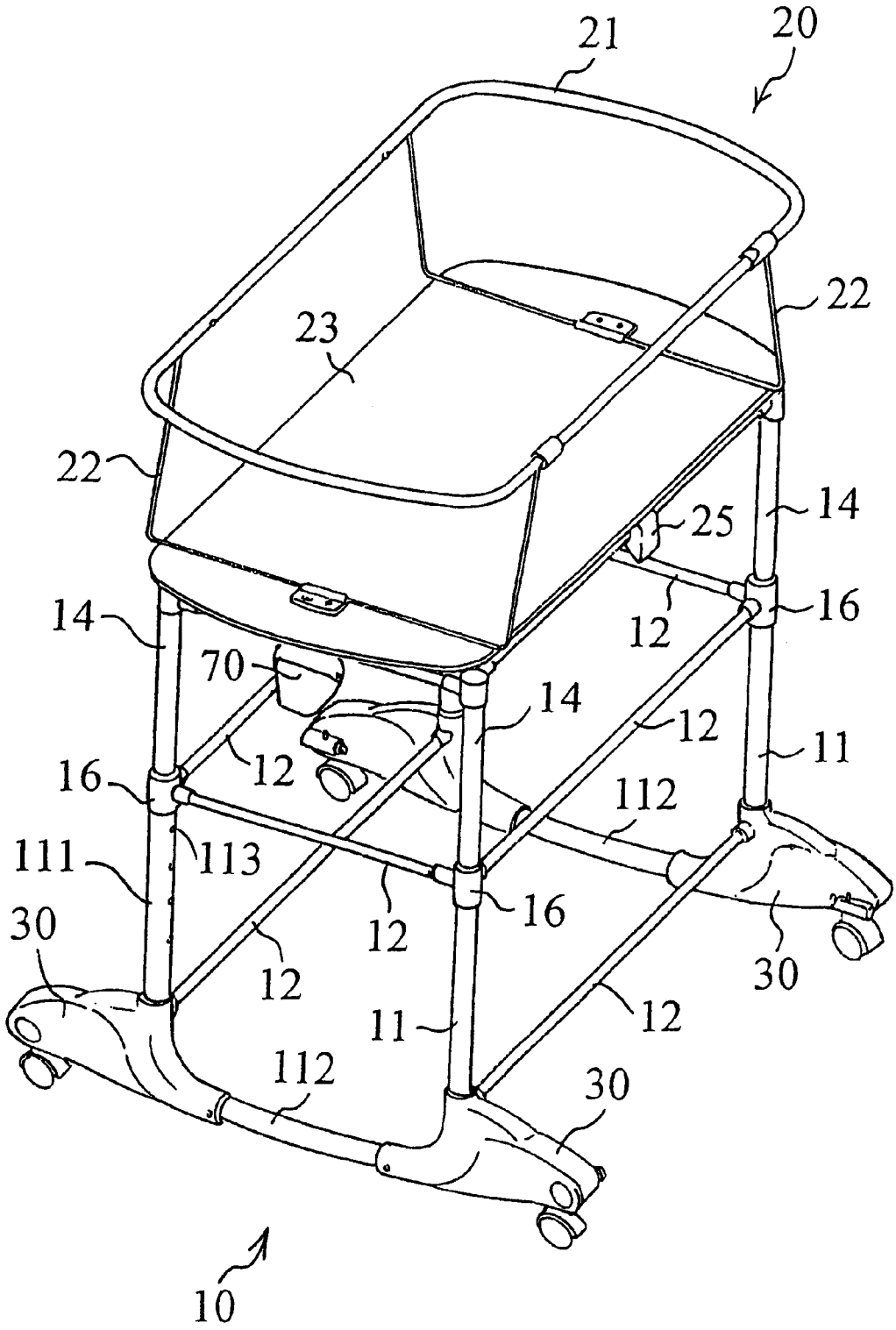
FIG. 1A is an top perspective view of a bassinet according to the present invention in an assembled state.

Referring now to the drawings in which an embodiment of the present invention is illustrated to describe the present invention.

Figure 1B:
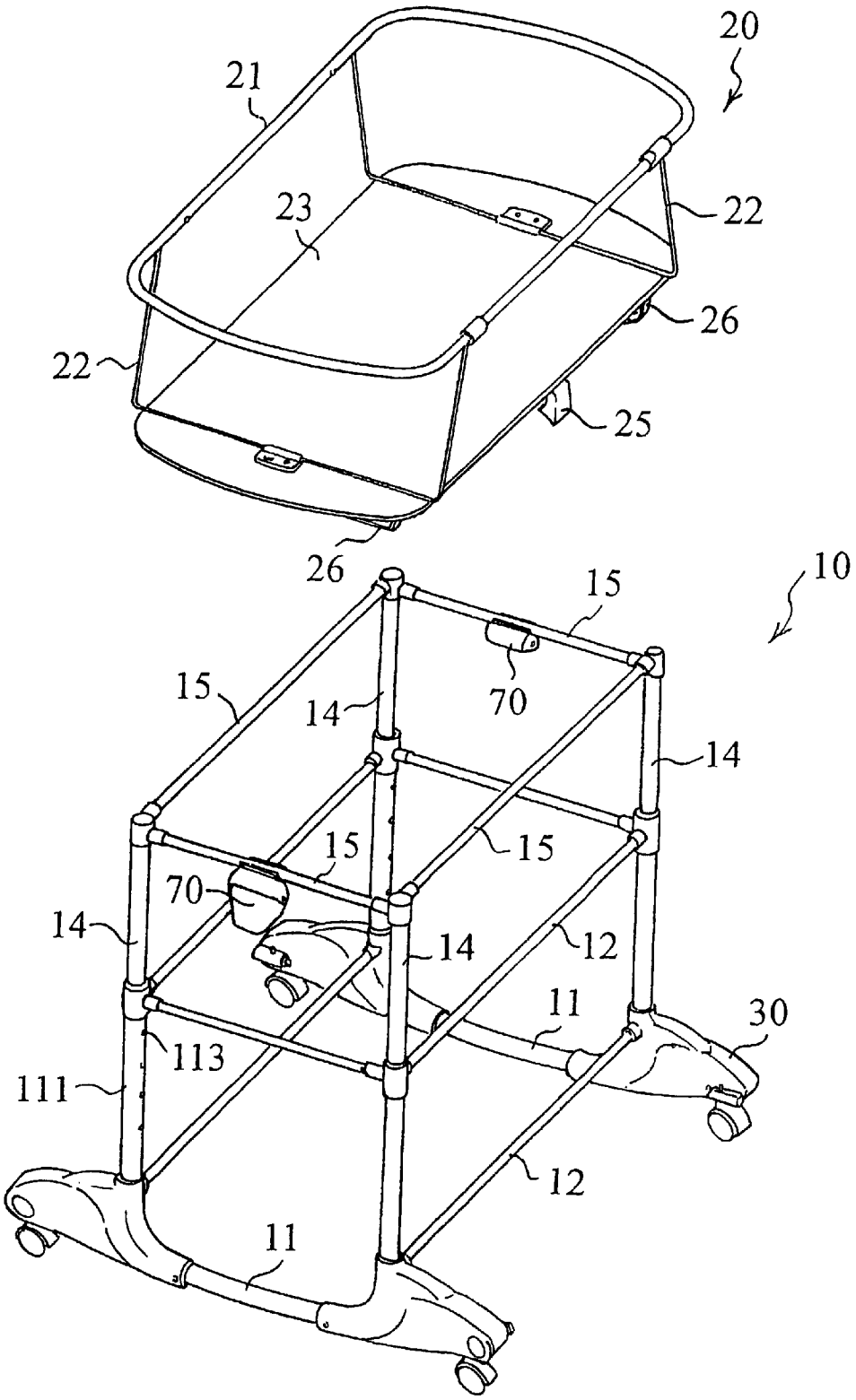
FIG. 1B is a perspective view of the bassinet shown in FIG. 1 which shows that the bed portion may be detached from the cart to use separately.

FIG. 1A is a top perspective view of a bassinet according to the present invention showing that the bassinet is in an assembled state. As shown in FIG. 1A, the bassinet generally comprises a cart 10, a bed portion 20 installed on top of the cart 10, height adjusting means 70 installed to the cart, and four leg assemblies 30 fixed to a bottom of the cart 10. FIG. 1B is a perspective view of the bassinet shown in FIG. 1 which shows that the bed portion 20 may be detached from the cart 10 to use separately.

The cart 10 consists of an upper cart portion and a lower cart portion. The lower cart portion generally includes two oppositely positioned upstanding U-shaped members 11, six connecting tubes 12 and four fastening member 16. Each U-shaped members 11 has two arm tubes 111 and an arcuate connecting portion 112 connecting two arm tubes 111. A plurality of height adjusting holes 113 are formed in a tube wall of each arm tubes 111 along an axial direction of the arm tube. Four of the six connecting tubes 12 are longer that the other two connecting tubes and connect an upper part and a lower part of both arm tubes 111 of a U-shaped members 11 to an upper part and a lower part of both arm tubes 111 of the oppositely positioned U-shaped members 11. The other two shorter connecting tubes 12 connect the arm tubes 111 of each U-shaped members 11 respectively. The upper cart portion includes four vertical tubes 14 which are respectively telescoply received in an arm tube 111 of the U-shaped member 11 at a first end thereof, and four frame rods 15 which connect a second end of each adjacent vertical tubes 14. The height of the cart 10 may be adjusted through the height adjusting means 70 which will be further described later by referring to FIGS. 5–9.

Figure 2:
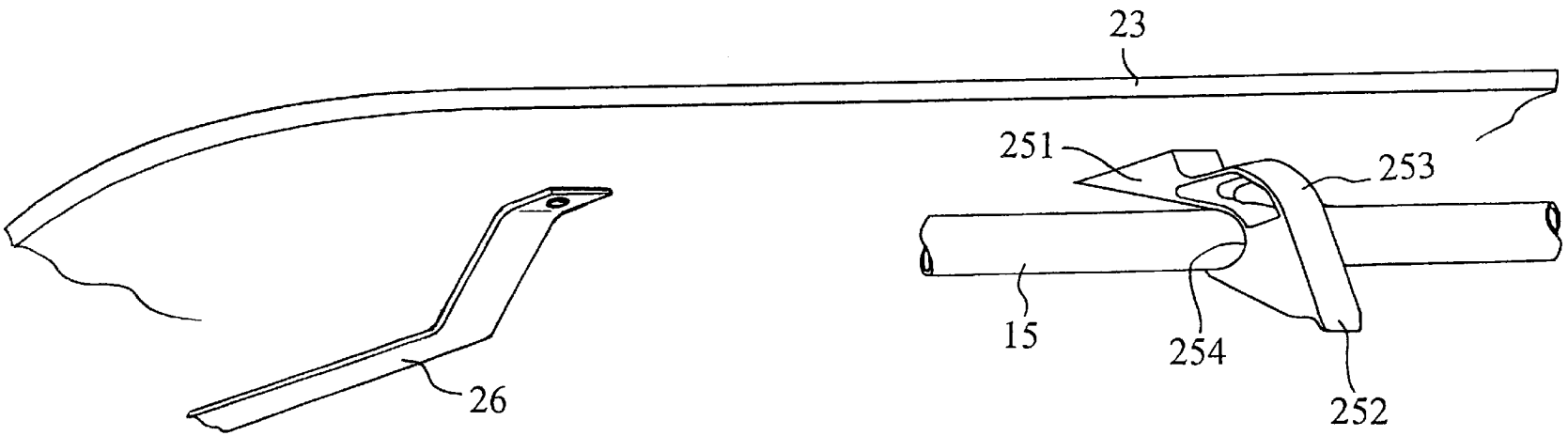
FIG. 2 is a partial perspective view of the bassinet according to the present application illustrating the structure of the C-shaped coupling member.
Figure 5:
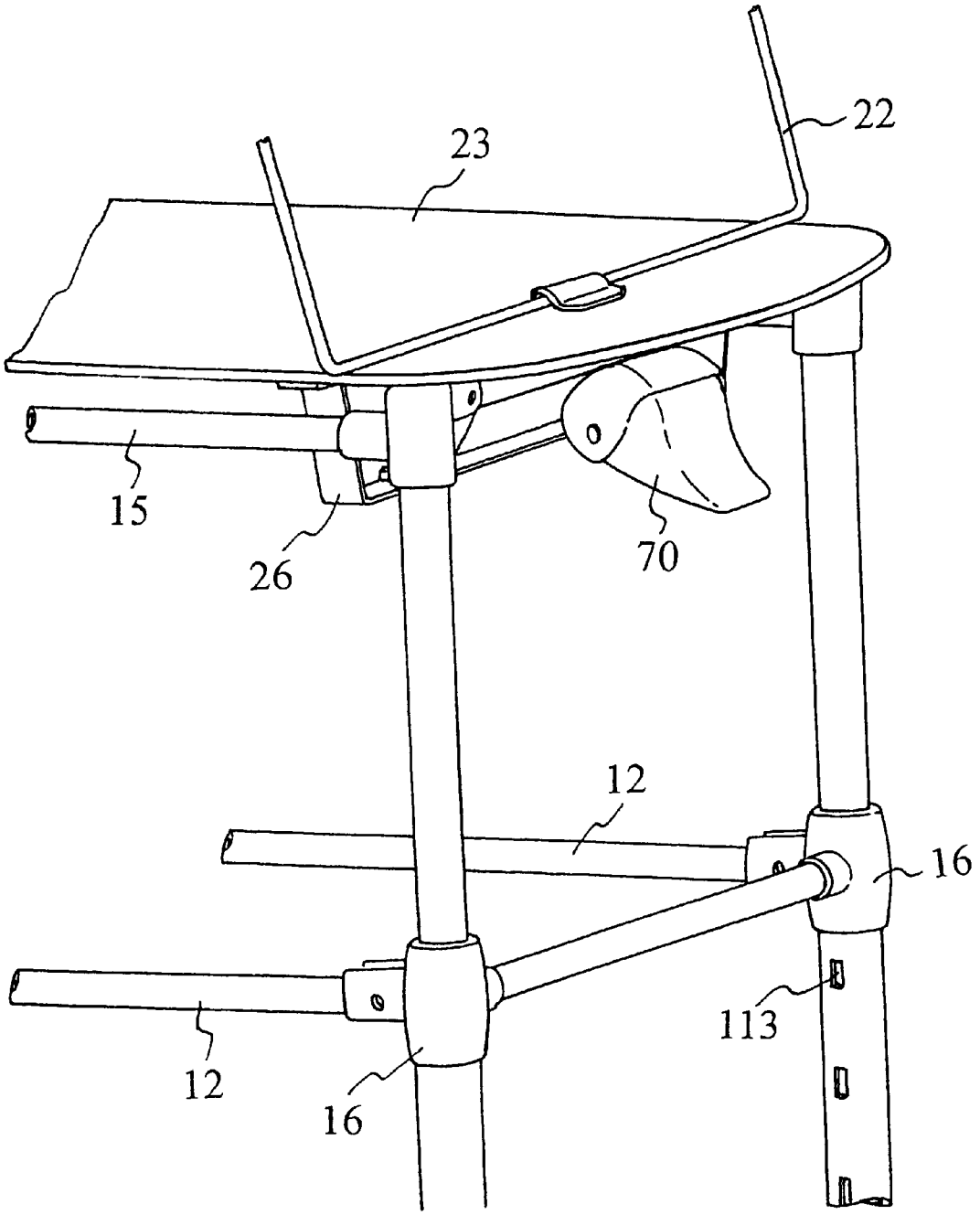
FIG. 5 is a partial perspective view of the bassinet according to the present application which illustrates the actuating device of the height adjusting means being installed to the cart.

The bed portion 20 includes a substantially rectangular side frame 21, two substantially U-shaped supports 22 coupled to the side frame 21, a rectangular bed board 23 fixed to a bottom of the supports 22, two coupling member 25 each fixed to a bottom face of the bed board 23 at a position adjacent to a long side of the bed board, and two substantially U-shaped support members 26 (only one is shown in FIG. 5) each fixed to the bottom face of the bed board 23 at a position adjacent to a short side of the bed board. As shown in FIG. 2, the coupling member 25 has an installation portion 251 for fixedly attached to the bottom face of the bed board 23, an actuating portion 252, and elastic connecting portion 253 connecting the actuating portion 252 to the installing portion 251, and a substantially C-shaped coupling portion 254 for engaging with a frame rod 15 at a long side of the upper cart portion. When the bed portion 20 needs to be detached from the cart 10, a user only needs to pull the actuating portion 252 of the coupling member 25 to cause the C-shaped coupling portion disengaging from the frame rod 15, then the bed portion 20 may be remove from the cart 10. The support member 26 are arranged such that when the bed portion 20 coupled to the cart 10 an outer side of the support members 26 may abut an inner side of the frame rods 15 at the long sides of the upper cart portion to prevent a relative movement between the bed portion 20 and the cart 10. In addition, Both the support members 26 has the same height and the height is equal to or greater than a height of the coupling member 25 such that the support members 26 may evenly support the bed portion 20 while it is detached from the cart 10 and use separately.

Figure 6:
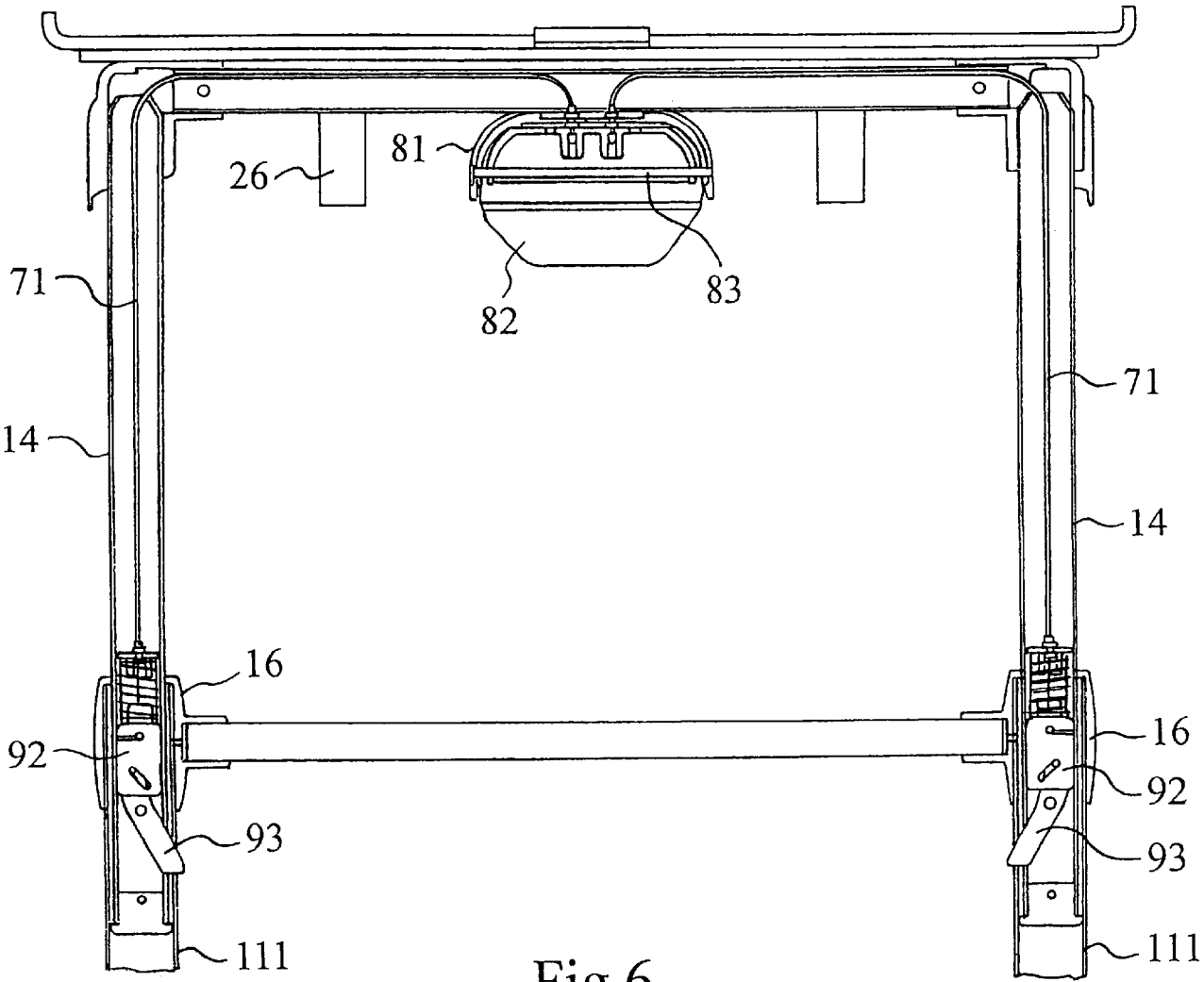
FIG. 6 is a partial cross-sectional view of the bassinet according to the present application illustrating the structural details of the height adjusting means.

Referring now the FIGS. 5–9 to describe the height adjusting means 70. As shown in FIG. 6, the height adjusting means 70 includes two actuating devices 80 each installed to a short side frame rod 15 of the upper cart portion, four locking devices 90 each fixedly installed inside a vertical tube 14, and four cables 71 disposed inside the frame rods 15 and the vertical tubes 14, wherein two of the cables 71 coupling two of the locking devices 90 to a actuating device 80, and the other two cables 71 coupling the other two locking devices 90 to the other actuating device 80.

Figure 7A:
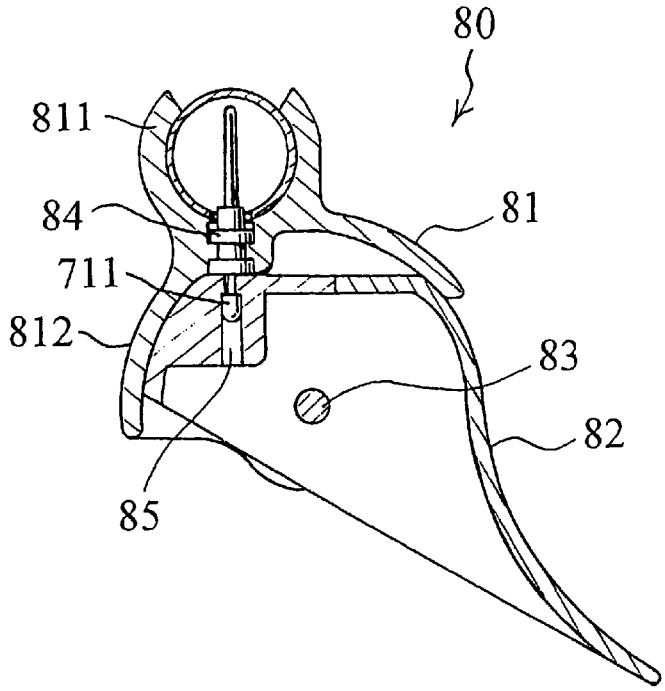
FIGS. 7A and 7B are cross-sectional views illustrating a locked state and an actuating state of the actuating device of the height adjusting means respectively.

Referring now to FIGS. 5, 6, 7A, and 7B to explain actuating device 80. The actuating device 80 includes an attaching member 81 having a substantially C-shaped attaching portion 811 for installing the actuating device 80 to the frame rod 15 and a receiving portion 812, an operating member 82 partially received in the receiving portion 812 and rotatably coupled to the receiving portion 812 via a rivet 83 passing through side walls of the receiving portion 812, and a cable fastener 84 fixed in the attaching member 81 and extending through a tube wall of the frame rod 15. The cable fastener 84 has a hollow body allowing the cable 71 passing therethrough. A secure groove 85 is provided in the operating member 82 at a position corresponding to the cable fastener 84. The cable 71 has an enlarged end 711, which engages with the secure groove 85 to connecting the cable 71 to the operating member 82, as shown in FIG. 7A.

Figure 8B:
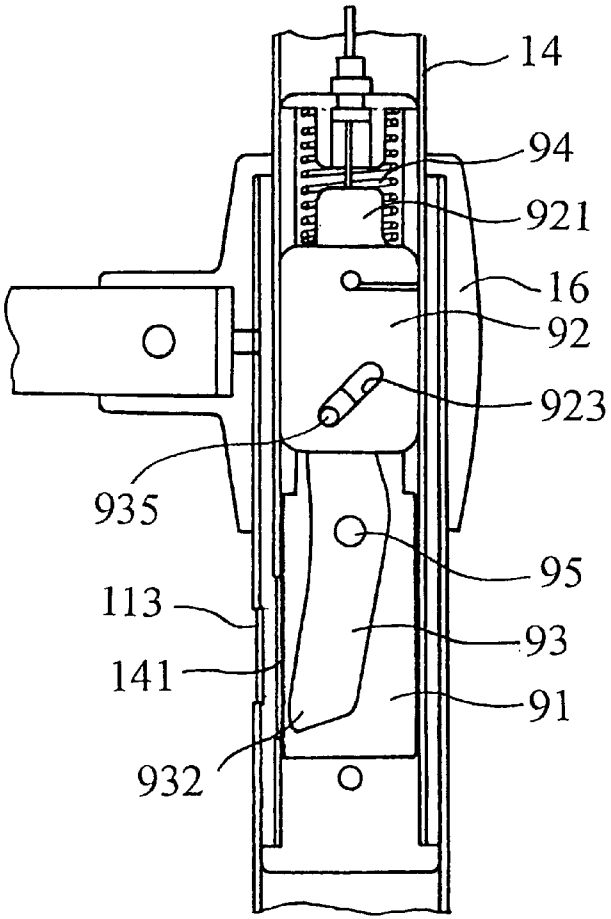
FIGS. 8A and 8B are partial cross-sectional views illustrating a latched and an unlatched state of the locking device of the height adjusting means.
Figure 8A:
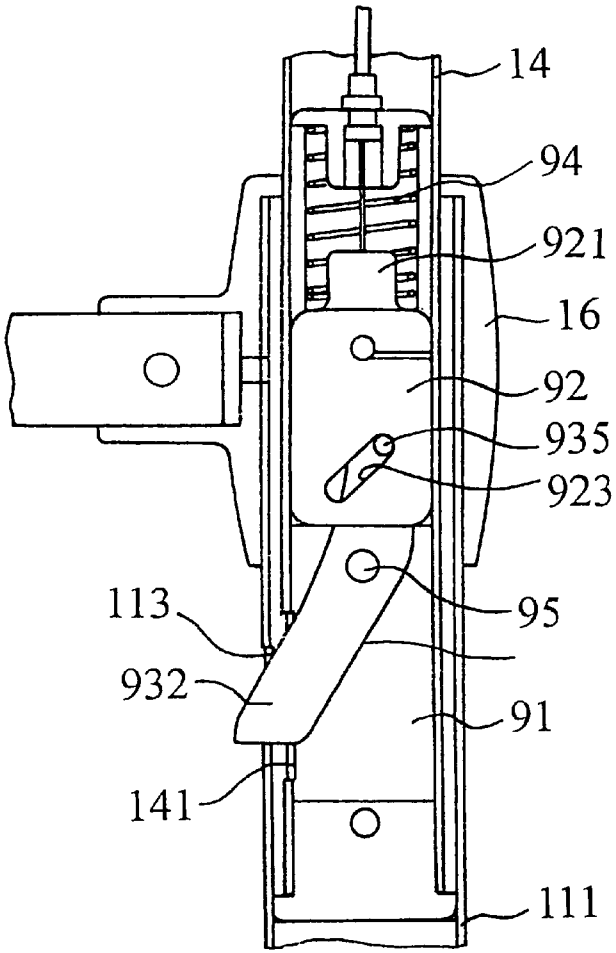
Figure 9:
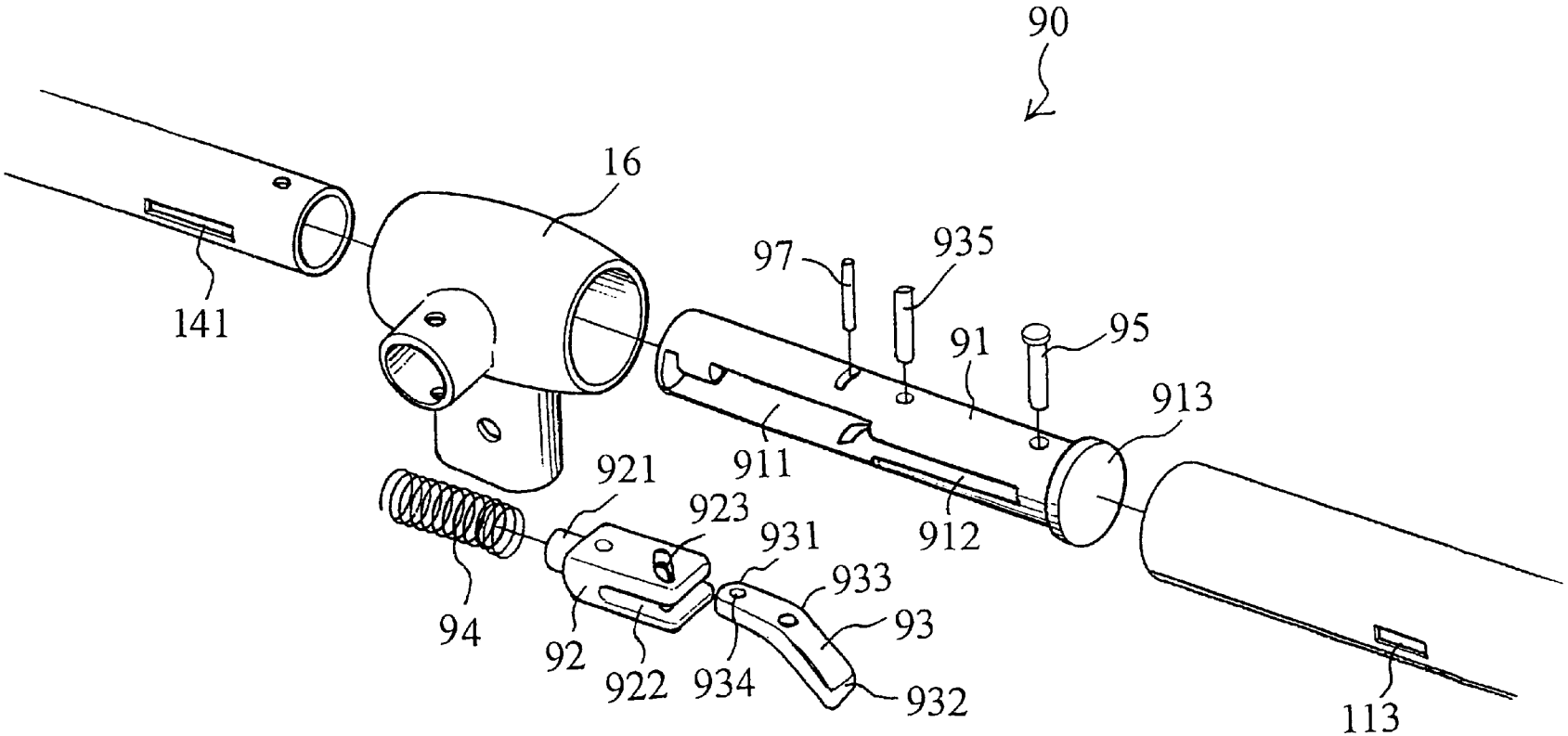
FIG. 9 is an exploded perspective view of the locking device of the height adjusting means.
Figure 10:
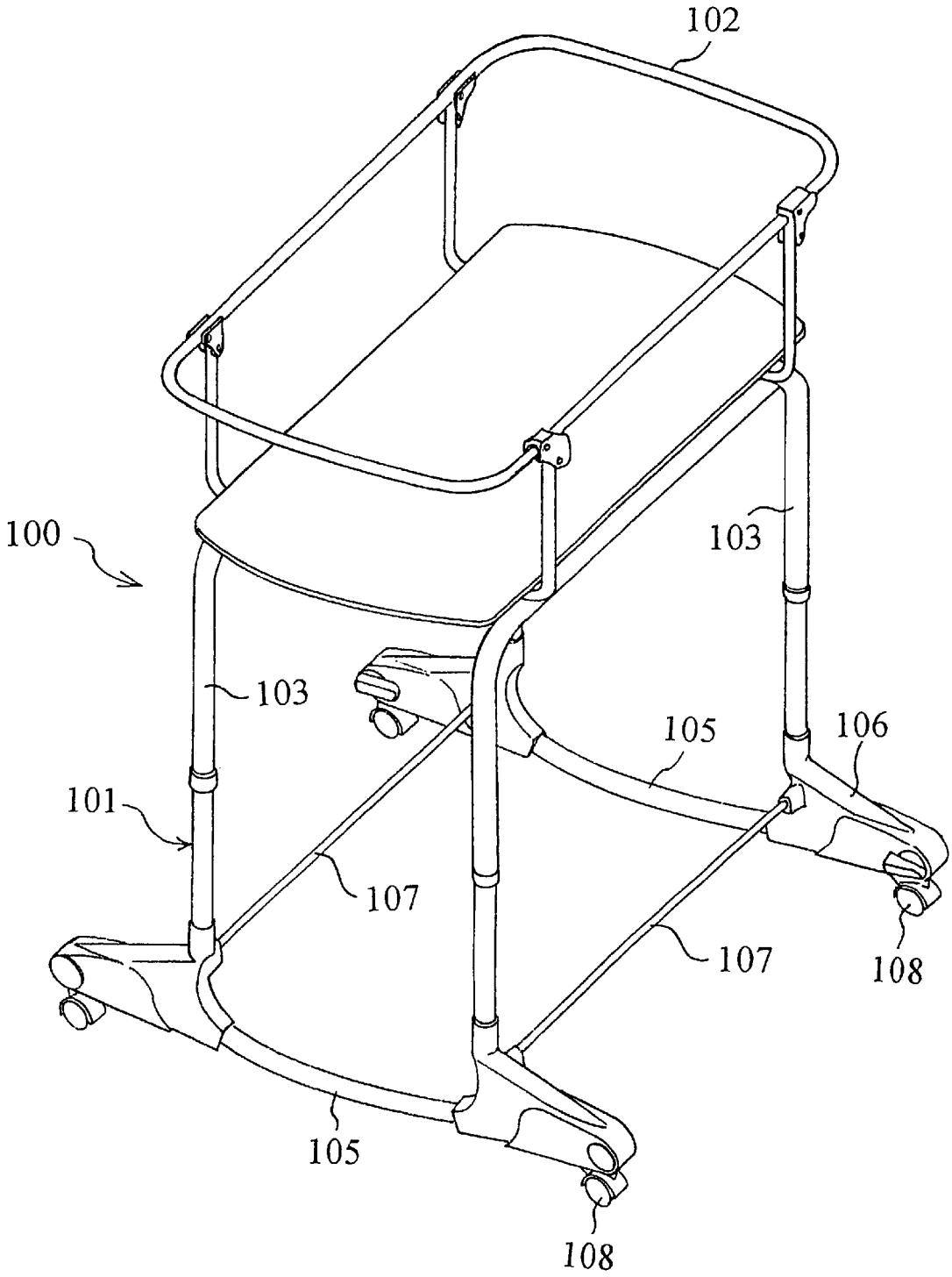
Fig.10 (PRIOR ART)
FIG. 10 is a perspective view illustrating a conventional bassinet.

Referring now to FIGS. 8A, 8B, and 9 to explain the locking device 90. The locking device 90 includes a plug member 91 which is disposed inside the vertical tube 14, a sliding block 92 slidably disposed in the plug member 91, a latch 93 pivotally coupled to the plug member 91, and a spring 94. The plug member 91 has a flange 913 formed at one end thereof with a diameter greater than an inner diameter of the vertical tube 14 to prevent the plug member 91 from sliding into the vertical tube 14 entirely. In addition, the diameter of the flange 913 is smaller that an inner diameter of the arm tube 111 of the U-shaped member 11 so as to allow the plug member 91 to slide within the arm tube 111 with the vertical tube 14. A protrusion 921 is formed at one end of the block 92 and an elongate opening 922 is formed at the other end of the block 92. In addition, two slant slots 923 are formed in opposite sidewalls defining the elongate opening 922 at an angle of 45 degree. Block 92 is slidably attached to the plug member 91 via a first pin 97 to thereby movably received in a first space formed in the plug member 92. One end of the spring 94 is attached to the protrusion 921 and the other end abuts a top wall defining the first space 911. The latch 93 is an elbow-shaped member and received in a second space 912 of the plug member 91. The latch 93 has a connecting end 931, a latching end 932 and an arcuate portion 933 disposed between the two ends, wherein a hole 934 is formed in the connecting end 931. The latch 93 is movably coupled to the block 92 by a pin 935 passing through the slant slots 923 and the hole 934 of the connecting end 631. In addition, the latch 93 is pivotally fixed to the plug 91 by a rivet 95 and arranged such that the latching end 932 may be pivoted to extend out of the second space 912 or retracted into the second space 912. Additionally, as shown in FIG. 9, a longitudinal elongate opening 141 is formed in a tube wall of the vertical tube 14 at a position corresponding to the latch member 93 while the locking device 90 is installed to the vertical tube 14. Referring to FIGS. 8A and 8B, the other end of the cable 71 is fixedly attached to the protrusion 921 of the block 92.

Referring now to FIGS. 7A, 7B, 8A and 8B to explain the operation of the height adjusting means 70.

Figure 7B:
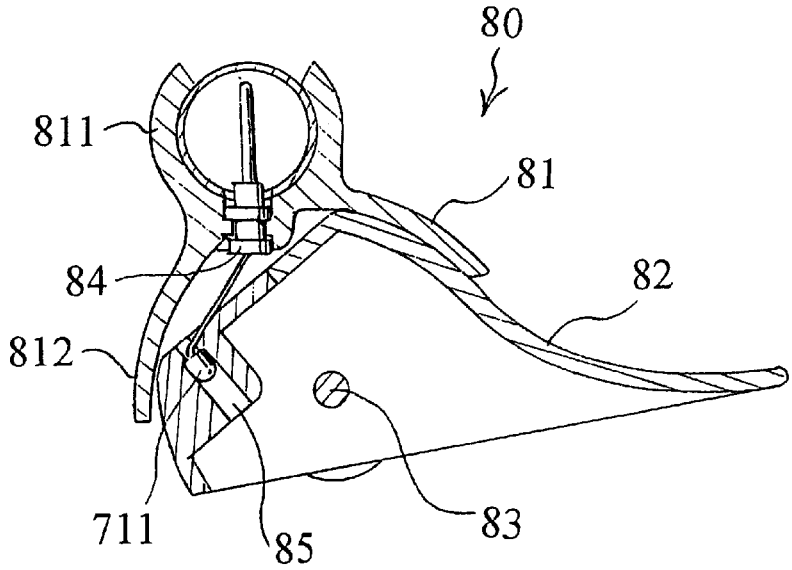

When the height of the bassinet needs to be adjusted, a user only needs to pull up the actuating member 82 of the actuating device 80 to cause the cable 71 to displace a distance, as shown in FIG. 7B. In response, the block 92 of the locking device 90 will be moved up a corresponding distance by the cable 71. When the block 92 is moved up, the pin 935 will be moved downward and forward along the slant slots 923 to thereby causing the latch 93 to pivot about the rivet 95, that is, the connecting end 931 of the latch 93 being swung forward and the latching end 932 being swung back into the second space 912 of the plug member 91, as illustrated in FIG. 8B. Then, the vertical tube 14 can be moved freely relative to the arm tube 111 because the latching end 932 is retracted into the plug member 91 and is not engaging with any height adjusting holes 113 of the arm tube 111 and the opening 141 of the vertical tube 14.

When the bassinet is adjusted to a desired height, the user only needs to release the force applied to the operating member 82, the block 92 then will be pushed downward by a return force exerted by the compressed spring 94 to cause the pin 935 to move upward and rearward along the slant slots 923 and cause the connecting end 931 of the latch 93 to be swung backward and the latching end 932 being swung out of the second space 912 of the plug member 91 and extending out of the arm tube 111 through the elongate opening 141 and one of the height adjusting holes 113 to thereby locking the bassinet at a desired position, as illustrated in FIG. 8A. At this moment, the operating member 82 of the actuating device 80 will return to a position illustrated in FIG. 7A.

Figure 3:
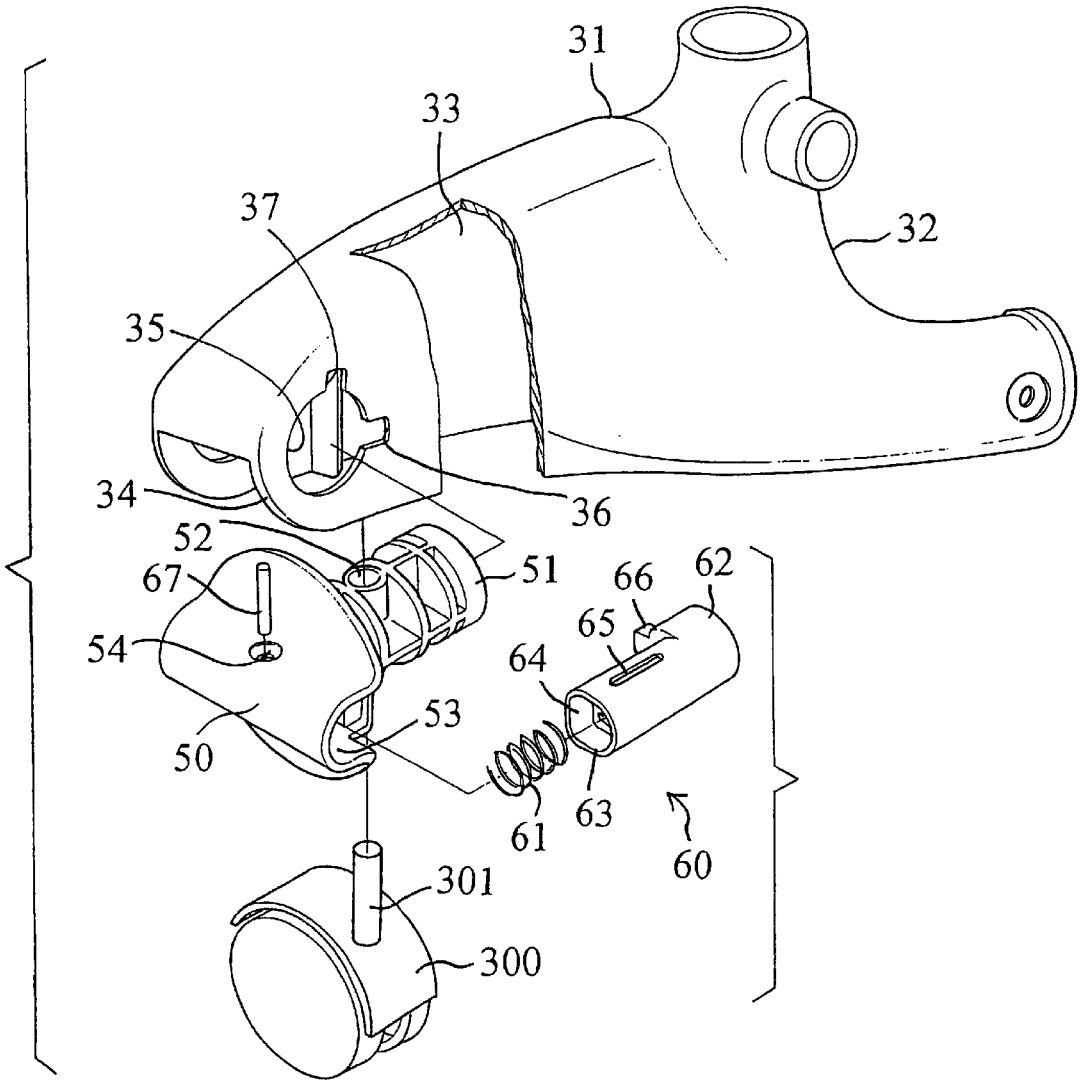
FIG. 3 is an exploded perspective view showing the structural details of the leg assembly according to the present application.

Next, the leg assembly 30 will be explained by referring to FIG. 3. As shown in FIG. 3, the leg assembly 30 includes a housing 31 and a wheel unit 40 which is pivotally coupled to the housing 31. The housing 31 has a substantially L-shaped installation portion 32 for attaching the leg assembly 30 to the U-shaped member 11, a receiving space 33, and a pivotal coupling portion 34. Two pivotal connecting openings 35 are formed in two opposite walls defining the receiving space 33. Two engaging notches 36, 37 are formed at a periphery of each of the pivotal connecting openings 35 and spaced apart at an angle of 90 degree, such as notch 36 is formed in a horizontal direction and notch 37 is formed in a vertical direction as shown in FIG. 3.

The wheel unit 40 includes a pivoting member 50 which passes through the pivotal connecting openings 35 to pivotally couple to the housing 31, a button unit 60 movably installed to the pivoting member 50, and a wheel 300 fixed to the pivoting member 50. The pivoting member 50 includes a substantially cylindrical body 51 having a transverse through hole 52 formed therein (i.e., a central axis of the through hole 52 is perpendicular to a central axis of the body 51) and an elongate hollow head 53 transversely formed at one end thereof and arranged such that a central axis of the head 53 is perpendicular to the central axis of the through hole 52. In addition, the head 53 has an open end, a close end and two pin holes 54 formed in opposite positions of a sidewall of the head 53.

As shown in FIG. 3, the button unit 60 is slidably received in the hollow space of the head 53. The button unit 60 includes a spring 61 disposed in the head 53 of the pivoting member 50, a hollow cylindrical shaped button 62 having an open end 63 which can be inserted into the head 53 of the pivoting member 50, a spring receiving space 64 formed at a position adjacent to the open end 63, two elongate axial slots 65 formed in opposite positions of a sidewall of the hollow cylindrical shaped button 62, and a latching portion 66 laterally protruding out from the close end of the button 62. The button 62 is slidably installed to the head 53 of the pivoting member 50 by a rivet 67 passing through the elongate axial slots 65 and the pin holes 54 of the head 53. The wheel 300 has a coupling shaft 301, which is inserted into the through hole 52 to thereby installing the wheel 300 to the pivoting member 50.

Figure 4A:
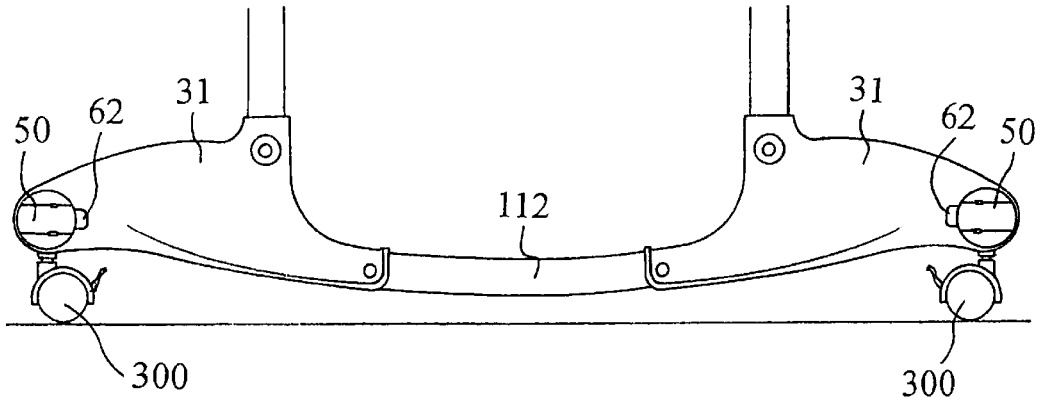
FIGS. 4A is a partial perspective view of the bassinet according to the present application which illustrates the wheel is in an extended state.
Figure 4B:
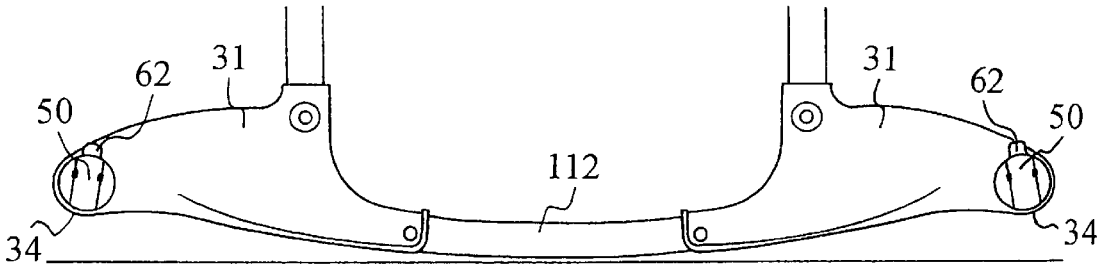
FIG. 4B is a partial perspective view of the bassinet according to the present application which illustrates the wheel is in an retracted state.

In sue, when the wheels 300 are need to move the bassinet the user only needs to axially press the button 62 of the button unit 60 and rotate the pivoting member 50 to align the latching portion 66 of the button 62 with the horizontal notch 36 and then release the button 62 to allow the latching portion 66 to engage with the horizontal notch 36 of the housing 31. Since the central axis of the coupling shaft 301 of the wheel 300 (i.e., the central axis of the through hole 52) is perpendicular to a central axis of the button 62 (i.e., the central axis of the head 53), thus when the button 62 is rotated and locked at a horizontal position by engaging the latching portion 66 with the horizontal notch 36, the wheel 300 will be rotated out of the receiving space 33 of the housing 31 and locked at a vertical position, as shown in FIG. 4A. When the wheels 300 need to be retracted, the button 62 is axially pressed again to cause the latching portion 66 disengaging from the horizontal notch 36 and to allow the pivoting member 50 to be rotated. Then the pivoting member 50 is rotated to align the latching portion 66 with the vertical notch 37 and then release the button to allow the latching portion 66 engaging with the vertical notch 37 to thereby retracting the wheel 300 into the receiving space 33 and keepin it therein, as shown in FIG. 4B. When the wheels 300 are retracted in the housing 31, the arcuate connecting portions 112 of the U-shaped members 11 will contact the ground and thus the bassinet may have a function similar to a rocking cradle. In addition, because the bottom of the pivotal coupling portion 34 of the housing 31 is substantially straight rather than arcuate, therefore the leg assemblies 30 may prevent the bassinet from falling due to over-rocking.

This invention has been disclosed in terms of specific embodiments. It will be apparent that many modifications can be made to the disclosed structures without departing from the invention. Therefore, it is the intent of the appended claims to cover all such variations and modifications as come within the true sprit and scope of this invention.

What is claimed is:

1. A bassinet comprising:

a cart including a lower portion which has two substantially U-shaped members, and an upper portion movably coupled to the lower portion, wherein each of the U-shaped members has two arm tubes and an arcuate connection portion connecting two arm tubes and each arm tube has a plurality of height adjusting holes formed in a tube wall along an axial direction, and the upper portion comprises four vertical tubes and four connecting rods, one end of each vertical tubes being telescopely coupled to an arm tube of the U-shaped members and the other end is coupled to and adjacent vertical tube by a connecting rod, wherein each vertical tube has a slot formed in a tube wall thereof to align with the height adjusting holes;

a bed portion detachably coupled to the upper portion of the cart; and four leg assemblies each coupled to a joint of the arm tube and the connection portion of the U-shaped members, wherein each leg assembly has a housing fixedly attached to the U-shaped members arid a wheel unit retractably coupled to the housing.

2. A bassinet according to claim 1, further comprising height adjusting means operablely coupled to the cart and adapted to allow a height of the cart may be adjusted by selectively interlocking the upper portion and the lower portion of the cart may.

3. A bassinet according to claim 2, wherein the height adjusting means comprises:

at least one actuating device operably installed to the upper portion of the cart;

at least one locking device installed inside the vertical tubes and having a lock member;

at least one cable operably connecting the at least one locking device to the at least one actuating device such that the at least one locking device may selectively engage/disengage with the slot of the arm tube of the U-shaped members and one of the height adjusting holes in the vertical tubes under the operation of the at least one actuating device.

4. A bassinet according to claim 3, wherein the at lest one locking device further comprises a plug member disposed inside the vertical tube, a block slidably installed in the plug member, a spring member disposed between the block and the plug member, and a latch operably coupled to the block and arranged such that it may selectively engage/disengage with the slot of the arm tube of the U-shaped members and one of the height adjusting holes in the vertical tubes as the block moving relative to the plug member.

5. A bassinet according to claim 3, wherein the wheel unit comprises a pivoting member which is pivotally coupled to the housing of the leg assembly, a wheel fixed to the pivoting member and arranged such that its central axis is perpendicular to a central axis of the pivoting member and when the pivoting member is rotated the wheel may be driven to rotate on a plane perpendicular to the central axis of the pivoting member, and a latching means operably coupled to the pivoting member for selectively locking the wheel in a retracted position and a erected position.

6. A bassinet according to claim 1, wherein the bed portion comprises a bed, a frame fixed to the bed, attaching means provided to a bottom face of the bed and adapted to detachably couple the bed to at least two oppose connecting rods of the upper portion of the cart, a number of support members provided at the bottom face of the bed and arranged such that the support members will abut an inner side of the connecting rods while the bed portion is coupled to the cart, a height of each of the support members is the same and equals to a height of the attaching member.

7. A bassinet according to claim 6, wherein the attaching means comprises two substantially C-shaped coupling members disposed at two opposite sides of the bottom face of the bed.

8. A bassinet according to claim 6, wherein a height of each of the support member is the same and equals to a height of the attaching member.

9. A bassinet according to claim 1, wherein a number of reinforcement rod arranged between arm tubes of the U-shaped members and between U-shaped members.

* * * * *